United States Patent [19]

Olyphant, Jr.

[11] 3,987,455

[45] Oct. 19, 1976

[54] MICROSTRIP ANTENNA

[75] Inventor: Murray Olyphant, Jr., Lake Elmo, Minn.

[73] Assignee: Minnesota Mining and Manufacturing Company, St. Paul, Minn.

[22] Filed: Oct. 20, 1975

[21] Appl. No.: 623,988

[52] U.S. Cl. ..... 343/829; 343/853; 333/84 M

[51] Int. Cl.[2] ..... H01Q 1/38

[58] Field of Search ..... 343/829, 846, 853, 854; 333/84 M

[56] References Cited

UNITED STATES PATENTS 3,377,592 4/1968 Robieux et al. ..... 343/100 SA 3,921,177 11/1975 Munson ..... 343/846

*Primary Examiner*—Eli Lieberman

*Attorney, Agent, or Firm*—Alexander, Sell, Steldt & DeLaHunt

[57] ABSTRACT

Microstrip antenna having one or more arrays of resonant dipole radiator elements. The radiator elements have an E coordinate dimension of approximately $\lambda o/2 \sqrt{\epsilon_r \mu_r}$. Bridge elements directly and conductively join adjacent pairs of radiator elements to provide energy distribution and the desired phase relationship. The radiator elements and bridge elements are in a broad surface which is uniformly spaced from a ground element by a dielectric sheet.

28 Claims, 10 Drawing Figures

MICROSTRIP ANTENNA

BACKGROUND OF THE INVENTION

There is a growing need for low cost, lightweight, low profile, readily mass-producible, high aperture-efficiency antennas of useful bandwidth in a variety of mass market applications.

The desirable characteristics of low cost, lightweight, low profile and mass producibility are provided in general by printed circuit antennas. The simplest forms of printed circuit antennas are "microstrip" antennas wherein flat conductive elements are spaced from a single essentially continuous ground element by a single dielectric sheet of uniform thickness. Such antennas are easily constructed from one layer of double clad circuit board material. Microstrip antennas with increased aperture efficiency and increased bandwidth would be very desirable.

One type of microstrip antenna utilizes radiating monopoles, each of which produce an omnidirectional radiation pattern in the plane of the antenna surface. Such an antenna is disclosed in U.S. Pat. No. 3,377,592 wherein short sections of otherwise uniform microstrip transmission lines are displaced in one direction from the centerline of the transmission line at intervals of one wavelength. All the outside corners of any one transmission line acquire the same charge simultaneously to produce monopoles and a radiation pattern that has a principal lobe that is tangential to the surface of the antenna.

A second type of microstrip antenna utilizes thin conductive resonant dipole radiator elements, each of which produces a radiation pattern having a principal lobe broadside (perpendicular) to the antenna surface. Each of such dipole radiator elements has two orthogonal coordinates that respectively define E and H planes of electromagnetic radiation for that radiator element. The E coordinate dimension of each radiator element is approximately one-half the dielectric wavelength $\lambda o \sqrt{\epsilon_r \mu_r}$, where $\lambda o$ is the free space wavelength, $\epsilon_r$ is the relative dielectric constant and $\mu_r$ is the relative permeability of the dielectric sheet. The dielectric sheet is generally $\lambda o/100 \sqrt{\epsilon_r \mu_r}$ to $\lambda o/10 \sqrt{\epsilon_r \mu_r}$ thick with the preferred range being $\lambda o/75 \sqrt{\epsilon_r \mu_r}$ to $\lambda o/15 \sqrt{\epsilon_r \mu_r}$. In an antenna it is desirable that such radiator elements radiate in a predetermined amplitude and phase relationship with respect to each other. The amplitude relationship may be a uniform illumination wherein all radiator elements contribute equally to a radiation pattern. Alternatively, the amplitude relationship may be a tapered distribution. The radiator elements should radiate in phase with respect to each other to create a broadside beam. An off-broadside beam may be created by having a progressive phase shift along rows or columns of radiator elements.

One class of microstrip antennas utilizing resonant dipole radiator elements employs capacitative coupling of energy to radiator elements. Such an antenna is disclosed in U.S. Pat. No. 3,016,536 wherein rectangular resonant dipole radiator elements are distributed on a broad surface. The E coordinate dimension of each radiator element is approximately $\lambda o/2 \sqrt{\epsilon_r \mu_r}$. The H coordinate dimension of each radiator element is considerably less than the E coordinate dimension. Such radiator elements form collinear arrays in the E coordinate direction with capacitative coupling between radiator elements for energy transfer. The center dipole of each collinear array consists of a pair of quarter wavelength radiator elements that form a balanced center-fed dipole. Several center-fed dipoles and their respective collinear arrays are driven from a balanced line to provide a two dimensional planar array. Such an antenna requires a balanced drive, has a poor aperture efficiency and a narrow bandwidth. The antenna has a rather large thickness because it is designed to use the ground plane as a reflector.

Another example of resonant dipole microstrip antennas utilizing capacitative coupling is contained in EMI-Varian Limited Bulletin PA2 11/73, entitled "Printed Antennae 2 – 36 GHz." In such an antenna the radiator elements are capacitatively coupled at various spacings to one or more feedlines running parallel to their E coordinate. The disclosed antenna has demonstrated low aperture efficiencies and poor side lobe control.

A second class of microstrip antennas utilizing resonant dipole radiator elements employs conductive coupling of energy to radiator elements. Antennas of this class are disclosed in U.S. Pat. Nos. 3,803,623 (Charlot) and 3,811,128 (Munson) and by Munson (I.E.E.E. Transactions on Antennas and Propagation, January, 1974, pp. 74–78). The E coordinate dimension of the radiator elements is approximately $\lambda o/2 \sqrt{\epsilon_r \mu_r}$. The H coordinate dimension is commonly greater than the E coordinate dimension and may be several wavelengths long. The individual input impedance of such radiator elements at frequencies around resonance is typically in the convenient range of 50 to 150 ohms depending on element dimensions and dielectric substrate characteristics.

A corporate feed network distributes energy between the transmission line and a plurality of microstrip radiator elements. A corporate feed network in microstrip comprises an interconnected pattern of thin conductive strips which connect the radiator elements into arrays. A terminal on the corporate feed network of an array serves for connection to a transmission line. Such a terminal may be connected directly to the transmission line or connected indirectly to the transmission line through additional corporate feed network strips.

A corporate feed network may be provided by a sequence of power dividers and tapered feed line sections or other impedance transformers which serve to distribute the desired amount of energy directly from (to) the transmission line to (from) each radiator element. The lengths of the feed line sections determine the phase relationship between the transmission line and each radiator element and thus control the phase relationship between radiator elements. Two-dimensional arrays of up to four or possibly eight radiator elements interconnected by a corporate feed network can be designed to produce a good aperture efficiency in the range of 90 percent based on ground element area. For arrays of greater numbers of radiator elements a decreased aperture efficiency is observed with conventional corporate feed because the corporate feed network becomes increasingly more extensive. The more extensive feed network necessitates increasing the spacing between the radiator elements, with such increased radiator element spacing in turn significantly reducing the aperture efficiency. Such proliferating feed lines also become lengthy which increases feed line losses. The proliferating feed lines often have lengths of various multiples of dielectric wavelengths such that slight changes in frequency produce undesirable phase shifts between radiator elements.

SUMMARY OF THE INVENTION

The present invention provides improved distribution of energy to resonant dipole radiator elements in a microstrip antenna. Antennas utilizing the present invention can be designed to have an increased efficiency and an increased bandwidth when compared to other microstrip antennas utilizing resonant dipole radiator elements.

The present invention utilizes thin conductive strips called bridge elements to distribute power to and control the phase relationship between such radiator elements. Each bridge element has a length providing approximately a phase reversal (in the range of 150° to 210° from end to end at the operating wavelength $\lambda o$. Each bridge element directly and conductively joins two adjacent radiator elements with those two radiator elements being defined as being in the same array. The width of each bridge element is less than the H coordinate dimension of one of the radiator elements it joins and less than one-half the H coordinate dimension of the other radiator element it joins.

Each array utilizing the present invention has a terminal on a radiator element off that radiator element's H coordinate. Such a terminal connects the array to an unbalanced transmission line either directly, or indirectly through a further feed network. In contrast, arrays utilizing corporate feed networks have terminals on the corporate feed network, which terminals connect the arrays to a transmission line.

The present invention utilizes the phase reversal property that exists across a dipole radiator element in the E coordinate direction to distribute energy via one or more bridge elements to other radiator elements within the array. Accordingly, there is at least one radiator element in an array of the present invention which has either 1. two bridge elements, or
2. a bridge element and a terminal for connection to a transmission line joined to it at points of opposite phase.

A simple form of the invention is a linear array of radiator elements that are series connected by bridge elements to form a chain-like structure of radiator elements that may or may not physically lie in a straight line. In a straight-line linear array having only one radiator element connected directly to a transmission line and operating as a transmitter antenna, power from the transmission line is distributed to the radiator elements that are electrically farther from the transmission line through the series connected radiator and bridge elements that are electrically closer to the transmission line. In a straight-line linear array having only one radiator element connected directly to a transmission line and operating as a receiver antenna, the increments of power received by other radiator elements pass through the series connected radiator and bridge elements that are electrically closer to the transmission line.

Antennas utilizing the present invention do not require an elaborate corporate feed network and thus provide high efficiency by minimizing feed network losses and permitting close spacing of radiator elements. High efficiency antennas can achieve a desired antenna gain with a relatively small area of circuit board, thus offering the additional advantage of low weight and low cost.

Antennas utilizing the present invention have surprisingly resulted in a significant increase in half-power bandwidth compared to conventional resonant dipole microstrip antennas. Therefore, antennas utilizing the present invention have a low sensitivity to changes in frequency and in the properties of the dielectric sheet.

Antennas with uniformly illuminated arrays are easily designed with the present invention because they can be formed from modular building blocks. For example, a linear straight-line array may be easily formed once the geometries of the radiator element and bridge element are established by simple repetition of such elements. Once one array is formed, simple repetition may provide a plurality of arrays. Because each array requires only one terminal for connection to a transmission line, a plurality of such arrays can be formed into an antenna by a simple and hence easily designed corporate feed network.

Arrays of the present invention are unexpectedly easy to match to common feed line impedances. In a typical situation the impedance at a terminal on one radiator element of an array may be inherently matched to 50 ohms with a voltage standing wave ratio (VSWR) of less than 1.5. The input impedance to one element is commonly capacitative; however, the addition of successive elements in an array progressively shifts the input impedance toward and into the inductive region. Such a resistive-inductive impedance can be easily compensated to become purely resistive by adding a small capacitative tab on the edge of the element having the terminal, with such a tab later being fabricated as part of the circuit board.

If a terminal on an array for connection to a transmission line is on a central radiator element of the array, that radiator element can serve as a 180° phase shifter such that one terminal can be used to feed signals to or accept signals from radiator elements on both sides of such central radiator element to produce an antenna array whose beam direction is very stable with respect to changes in frequency and in the dielectric sheet properties such as dielectric constant and thickness.

To a first order approximation, the E coordinate dimension of a dipole radiator element in relation to the dielectric constant determines a possible range of operating frequency for the radiator element. To a similar first order approximation, the bridge element which interconnects two radiator elements determines the phase relationship between the two radiator elements when they are operating as an antenna. In an array that utilizes the present invention and has a broadside beam, to a first order approximation there is 180° of phase shift across each radiator element and each bridge element such that each radiator element is in phase (360°) with respect to adjacent radiator elements with which it is interconnected.

The radiator elements can be various sizes and shapes. The E coordinate dimension of each radiator element should be approximately $\lambda o/2\sqrt{\epsilon_r \mu_r}$. The H coordinate dimension can be various lengths. The H coordinate dimension is greater than the width of the bridge element and may be several wavelengths long. If the H coordinate dimension is greater than about one dielectric wavelength, multiple bridge elements may be required between two radiator elements. Preferably the natural resonant frequency modes in the E and H coordinate dimensions for any given radiator element are different. Because the radiator element H coordinate is greater than the width of the bridge element, the characteristic impedance of the radiator elements considered as a section of transmission line will be lower than the characteristic impedance of the bridge elements. The individual radiator elements may be symmetrical or asymmetrical and each radiator element can conceivably have a different shape. While the radiator elements are often physically located adjacent to each other in the E coordinate direction, they can be physically located in other directions on the surface of the antenna dielectric sheet. However, it is important that the E coordinates of the respective radiator elements be approximately parallel regardless of the physical location of the radiator elements such that their radiation patterns will reinforce each other in a predetermined manner.

The bridge elements can be various sizes and shapes as long as they provide approximately a phase reversal (150° to 210°) from end to end at the operating wavelength $\lambda o$. Bridge elements can vary in width with narrower bridge elements having a higher characteristic impedance when considered as sections of a transmission line. Such characteristic impedance can be determined from Wheller's Wide Strip Approximation Chart (Microwave Engineers Handbook, Vol. I, 1971, publisher: Horizon House-Microwave Incorporated, p. 137) which gives impedance in terms of strip width, dielectric constant and dielectric thickness. It is believed that if bridge elements get too narrow they will not effectively transmit energy. Maximum bridge element width is such that the bridge element is less than the H coordinate dimension of one of the radiator elements it joins and less than one-half the H coordinate dimension of the other radiator element it joins. It is believed that if the bridge elements are too wide they will interfere with the ability of the radiator element to radiate. For a given bridge element the length is adjusted to provide the desired phase relationship. Relatively speaking, a narrower bridge element will have a longer length for the same phase shift.

Once an array of the present invention is built, it is believed that similar arrays can be designed to operate at other desired frequencies by suitably scaling the array pattern and dielectric sheet thickness in the approximate ratio of the desired wavelength to the wavelength of the working model.

DESCRIPTION OF THE PREFERRED EMBODIMENTS

Figure 1:
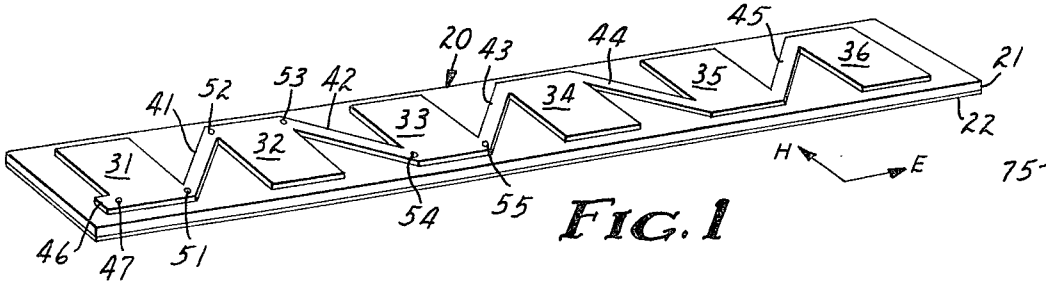
FIG. 1 is a schematic perspective view of a first embodiment of an antenna according to the present invention.

As shown in FIG. 1, an antenna 20 includes a dielectric sheet 21 which uniformly separates a ground element 22 from radiator elements 31 through 36, bridge elements 41 through 45 and a capacitative tab 46. The antenna 20 is made from a double copper-clad low-loss dielectric sheet 21 by etching one copper layer to form radiator elements 31 through 36, bridge elements 41 through 45 and capacitative tab 46. The dielectric sheet 21 is polytetrafluoroethylene reinforced with glass fiber cloth with the sheet having properties in accordance with U.S. military specification MIL—P–13949E Grade GX with a relative dielectric constant $\epsilon_r$ of about 2.45, a relative permeability $\mu_r$ of 1.0 and a thickness of about 0.76 mm. Each copper layer is about 34 micrometers thick. The rectangular radiator elements 31 through 36 are each 1.38 cm by 2.05 cm and are located on 2.54 cm centers. Each bridge element 41 through 45 is 0.2 cm wide and conductively joins a pair of adjacent radiator elements diagonally across the space between them. The dielectric sheet 21 and the ground element 22 are each 2.54 cm by 14.7 cm in the broad surface. The antenna is fed at terminal 47 from a 50-ohm unbalanced coaxial transmission line (not shown) that passes through the ground element from the backside.

The antenna has a broadside beam (principal lobe perpendicular to the antenna surface) at 6406 MHz, has about 90% aperture efficiency based on ground element area when matched with the tab 46 and has an input voltage standing wave ratio (VSWR) of 1.3 terminating a 50-ohm line at such frequency. It is believed the broadside beam indicates all radiator elements are in phase with respect to each other. The aperture efficiency figure includes the VSWR mismatch and is based on the theoretical gain $G = 4\pi A/(\lambda o)^2$ where A is the ground element area and $\lambda o$ is the free space wavelength.

The antenna's first side lobes in the E plane pattern of maximum gain are 12.6 db and 14.2 db below maximum gain.

The antenna's measured half-power beam width in the E plane at frequency of maximum gain is 14.2°. The theoretical beam width for a uniformly illuminated aperture 14.7 cm long is 16.1°. Such theroetical beam width is based on the formula (50.6) $(\lambda o)/L$ where $\lambda o$ is the free space wavelength and L is the length of the aperture (ground element) in that plane.

The antenna's beam is frequency steerable over a total angle of 20° when the frequency is scanned from 6112 MHz to 6742 MHz.

Applicant believes that when the array in FIG. 1 is operating as an antenna with a broadside beam, to a first order approximation there is a phase reversal respectively across each radiator and bridge element. For example, radiator element 32 would have 180° of phase shift between points 52 and 53; and bridge element 42 would have 180° of phase shift between points 53 and 54 where it conductively joins radiator elements 32 and 33. Thus radiator elements 32 and 33 would be in phase with respect to each other. Under such circumstances, it is believed that the incident currents, resonant currents and reflected currents all synchronously reinforce each other. For example, the incident currents entering radiator element 32 at 52, the reflected currents entering radiator element 32 at 53 and the resonant currents within radiator element 32 would synchronously reinforce each other. It may be desirable to slightly shorten the E coordinate dimension of the radiator element 36 electrically farthest from the terminal 47 to optimize performance. It is believed that this adjusts the phasing of the reflected currents and compensates for the absence of additional bridge and radiator elements.

The bridge elements in FIG. 1 each join a pair of adjacent radiator elements diagonally across the space between such radiator elements, permitting close spacing of radiator elements for high efficiency. Such an arrangement drives adjacent radiator elements such as 32 and 33 on opposite sides of their respective E coordinates such as at 52 and 54 such that any cross polarization of the E fields in adjacent radiator elements is self-canceling in the far field. By connecting bridge elements such as 41 and 42 to a radiator element such as 32 at points such as 52 and 53 which define a line parallel to the E coordinate dimension, the currents passing through the radiator element are parallel to and add to the resonant currents within the radiator element. If bridge elements 42 and 44 were arranged such that they were parallel to bridge elements 41, 43 and 45 while still joining their respective radiator elements diagonally across the space between such radiator elements, the antenna would still radiate but the radiated E plane would be slightly skewed from the E coordinate direction of the radiator elements.

Figure 2:
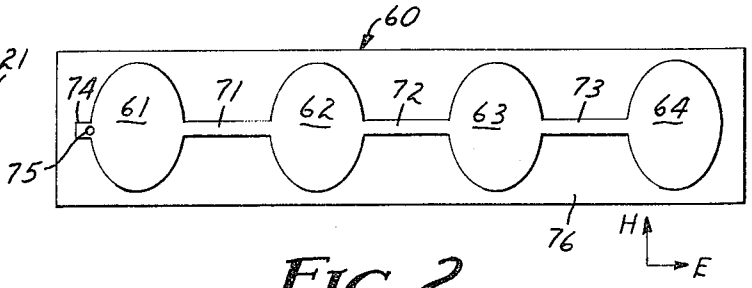
FIG. 2 is a plan view of a second embodiment of an antenna according to the present invention.

A second embodiment utilizing the present invention is an antenna 60 shown in FIG. 2. Its elliptical radiator elements 61 through 64 each have an E coordinate dimension of 1.52 cm, an H coordinate dimension of 2.03 cm and are located on 3.0 cm centers. Bridge elements 71 through 73 are each 0.2 cm wide and conductively join respective radiator elements along a center line as shown. A capacitative tab 74 is for impedance matching. The antenna is fed at terminal 75 from an unbalanced 50-ohm coaxial transmission line (not shown). A dielectric sheet 76 and a ground element (not shown) are each 2.54 cm by 11.5 cm in the broad surface.

The antenna 60 has an efficiency of about 78 percent at 6959 MHz, the frequency of maximum gain, when properly matched to a 50-ohm line. Its principal lobe is tilted 3° to 8° off broadside depending on frequency away from terminal 75, indicating the bridge elements are slightly longer than those for a broadside beam. The antenna 60 will not operate efficiently at a frequency that is low enough to bring the principal lobe to broadside.

Figure 3:
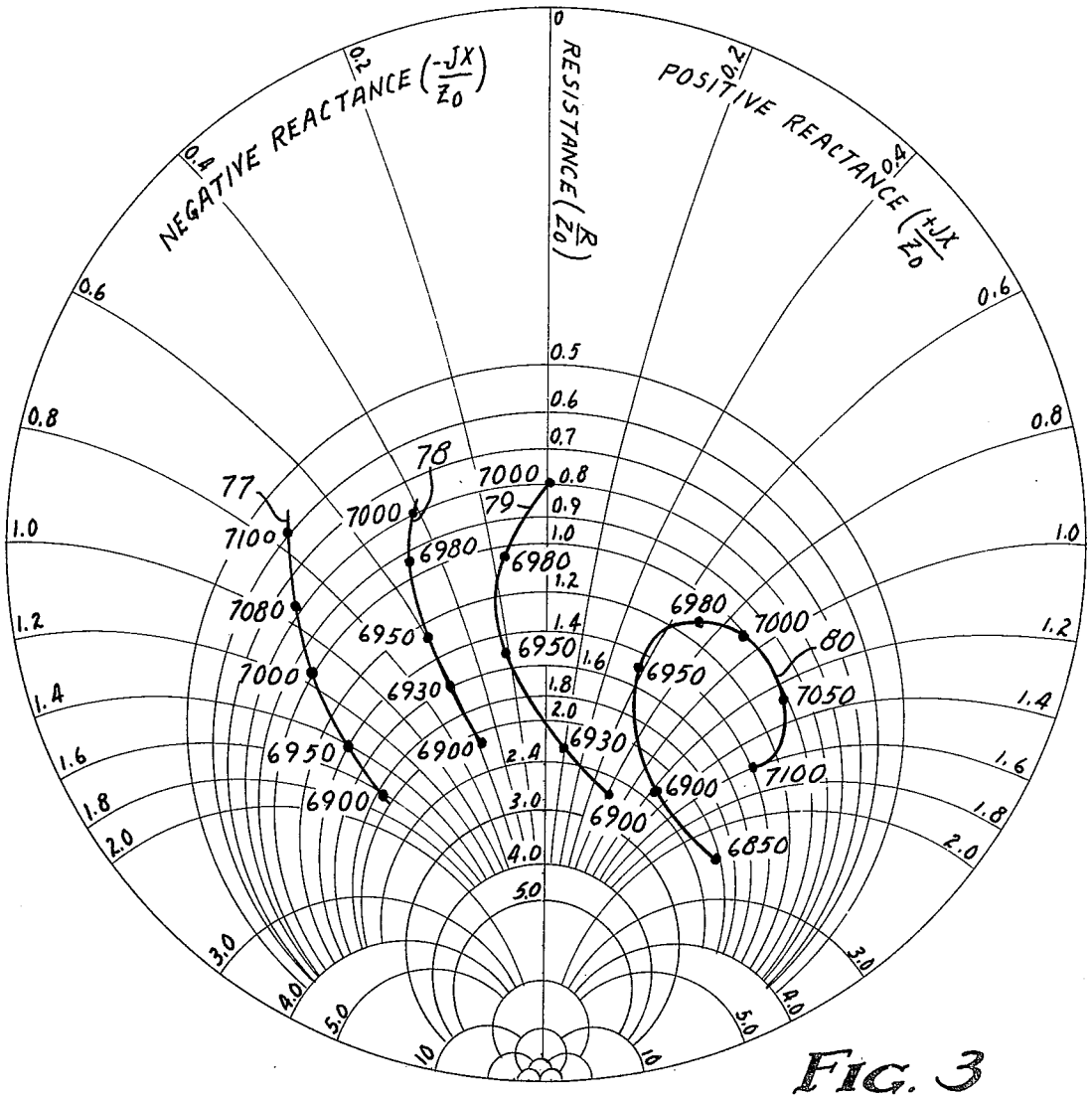
FIG. 3 is a Smith Chart showing the complex input impedance of antennae constructed as in FIG. 2 with one to four radiator elements.

FIG. 3 represents the complex input impedance at terminal 75 as a function of frequency on a Smith Chart normalized to 50 ohms without a matching tab 74 as the antenna 60 was built starting with element 61 and successively adding units of one bridge element and one radiator element. Curves 77, 78, 79 and 80, respectively, represent the complex impedance with 1, 2, 3 and 4 radiator elements. As successive units of one bridge element and one radiator element were added, the resistive impedance in the neighborhood of 6950 MHz remained relatively constant while the capacitative reactance progressively decreased. In the four-element configuration the complex impedance moved into the inductive region. FIG. 3 shows that the four element array has an inherent unmatched minimum VSWR of 1.83 at about 6960 MHz. By proper placement of the capacitative tab 74, the input VSWR for the four element array was reduced to less than 1.2 over the range 6950 to 7000 MHz. The impedance, referenced to the back side of the board where the coaxial center conductor passes through a hole in the ground element to attach to terminal 75, was measured using a slotted line impedance meter.

By adjusting the size and location of the capacitative tab it is possible to not only reduce the VSWR but also move the frequency of minimum VSWR around in a limited range. Prior to making such an adjustment an array of radiator and bridge elements is established. Then, a movable tab is made from pressure-sensitive copper foil tape such as Scotch brand Electrical Tape No. X1194. The tab is made sufficiently large such that it can project beyond and overlap the radiator element having the feedpoint. The tab is adjusted while the terminal is connected by a coaxial connector through the ground element to a VSWR bridge such as Wiltron Company Model 64A50, 3 to 8 GHz. The swept frequency output from the bridge is observed on an oscilloscope while a tab is moved along the periphery of the radiator element having the terminal with the tab's size and location being varied. It has been observed that far more versatility is achieved in reducing VSWR and in adjusting the frequency of minimum VSWR than would be expected by a simple theory of pure capacitative shunting. Once the size and location of a tab is determined it may be reproduced as part of the copper-clad etching process. Although the array in FIG. 3 is impedance matched to a transmission line at terminal 75, the radiator elements are not impedance matched to their respective bridge elements within the array itself.

Figure 4:
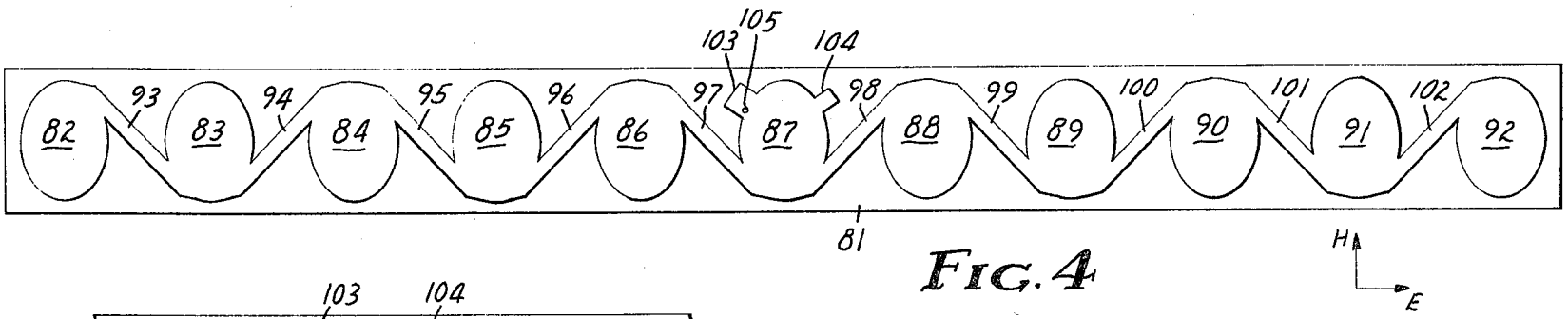
FIG. 4 is a plan view of a third embodiment of an antenna according to the present invention.
Figure 5:
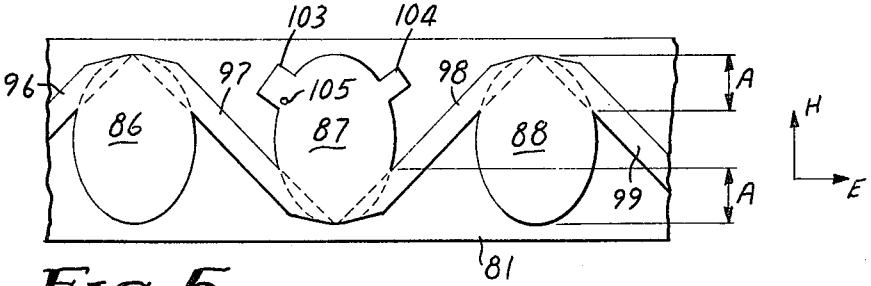
FIG. 5 is a fragmentary drawing showing the relationship between the radiator and bridge elements in FIG. 4.

FIG. 4 shows a third embodiment wherein the dielectric sheet 81 is 1.5 mm thick. The elliptical radiator elements 82 through 92 each have an E coordinate dimension of 1.52 cm, an H coordinate dimension of 2.03 cm and are located on 2.54 cm centers. The bridge elements 93 through 102 are each 0.25 cm wide and conductively join to the radiator elements as shown in the fragmentary drawing of FIG. 5. The dimensions A are 6.35 mm. Capacitative tabs 103 and 104 are attached to element 87. This antenna is fed by an unbalanced 50-ohm coaxial transmission line, the center conductor of which passes through the ground element and contacts terminal 105 on radiator element 87. By placing the terminal 105 on a central radiator element, it is possible to drive the radiator elements on both sides of element 87 in phase while utilizing element 87 as both a phase reversing element and a radiator element. This central feed provides a desired broadside beam direction that is substantially independent of variations in frequency and variation in the dielectric constant and thickness of the dielectric sheet.

This antenna exhibits side lobes 16.2 db and 17.5 db below maximum gain which is believed to indicate the radiation pattern can be tapered by using long arrays. The half-power beam width of the antenna is 8.5° compared to a theoretical beam width of 8.1° if the aperture were uniformly illuminated.

By placing tabs 103 and 104 on radiator element 87 the input VSWR was reduced to less than 1.05. The array in FIG. 4 has a bandwidth of 5% within which the input VSWR remains less than 1.7. It is believed that interaction among elements of the array maintains the input VSWR of arrays, particularly those with many elements, at a desirably low value over a large frequency range.

Figure 6:
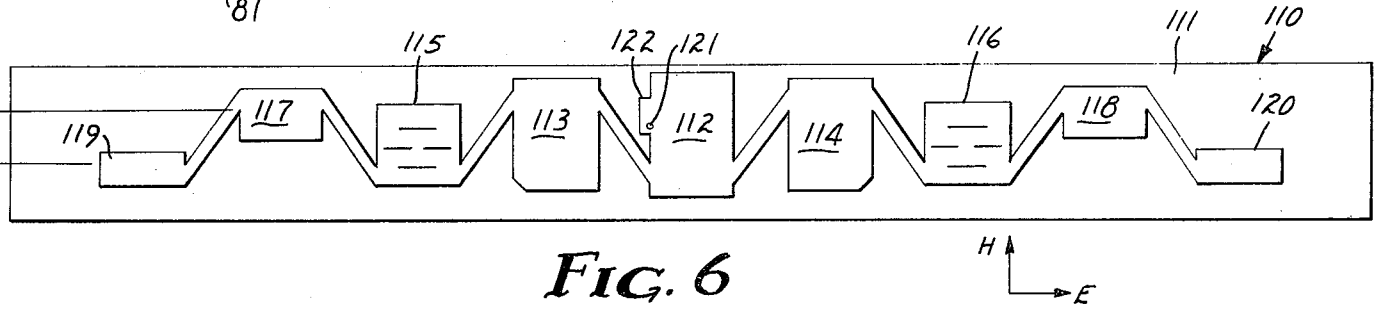
FIG. 6 is a plan view of a fourth embodiment of an antenna according to the present invention.

FIG. 6 shows a fourth embodiment wherein the dielectric sheet 111 is 0.76 mm thick. Each of the rectangular radiator elements 112 through 120 have an E coordinate dimension of 1.38 cm and they are on 2.30 cm centers. The H coordinate dimension of radiator elements 112, 113 and 114, 115 and 116, 117 and 118, 119 and 120 are respectively 2.95 cm, 1.84 cm, 1.33 cm, 0.82 cm and 0.6 cm. The bridge elements are each 0.2 cm wide, approximately 1.5 cm long and they are attached to their respective radiator elements as shown with the dimension B being 0.8 cm. A terminal 121 for connection to an unbalanced transmission line and a capacitative matching tab 122 are on radiator element 112. Radiator elements 115 and 116 have slits cut in them as shown to minimize cross polarization because these elements are almost square.

The antenna in FIG. 6 exhibits side lobes 19 db and 20 db below maximum gain which is believed to indicate the radiation pattern can be tapered by varying the size of the radiator elements. The half-power beam width of this antenna is 12.3° compared to an estimated theoretical beam width of 10.4° if the aperture were uniformly illuminated.

Figure 7:
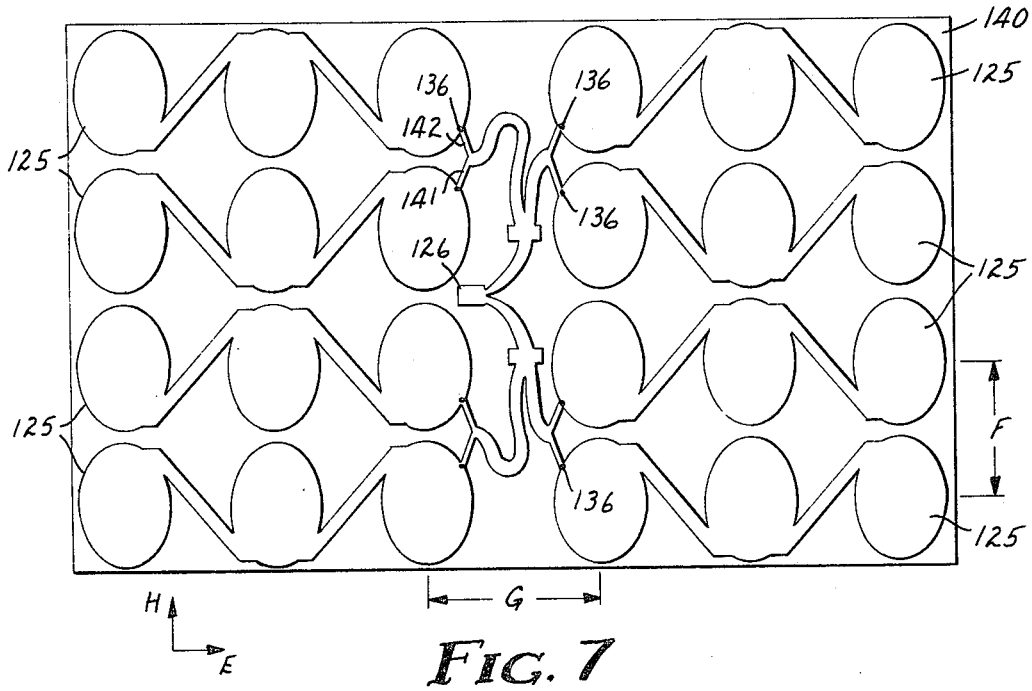
FIG. 7 is a plan view of a fifth embodiment of an antenna, one that has a plurality of arrays, each of which utilizes the present invention.

FIG. 7 shows a fifth embodiment wherein eight essentially identical three element arrays 125 are fed by a conventional corporate power divider feed network 126 that includes two 180° phase shifters.

Figure 8:
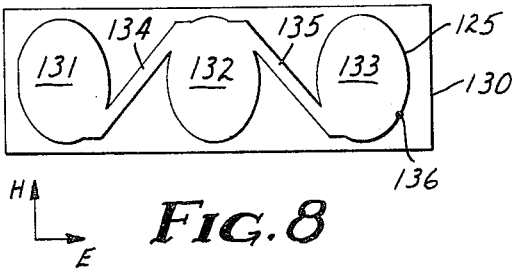
FIG. 8 is a plan view of an array that is essentially identical to each of the arrays in FIG. 7.

FIG. 8 shows a three element array 125 that is essentially identical to those in FIG. 7. Dielectric sheet 130 and a ground element (not shown) are 2.48 cm by 7.2 cm. The dielectric sheet is 0.76 mm thick. Elliptical radiator elements 131, 132 and 133 each have an E coordinate dimension of 1.52 cm, an H coordinate dimension of 2.03 cm and are located on 2.54 cm centers. Bridge elements 134 and 135 are each 0.2 cm wide. A terminal 136 for connection to an unbalanced transmission line is on radiator element 133.

Figure 9:
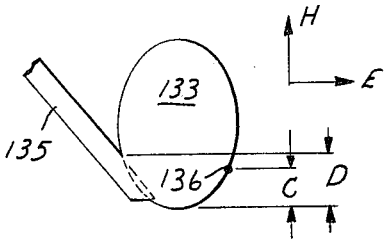
FIG. 9 is a fragmentary drawing showing the relationship between a feed terminal, a radiator element and a bridge element of the array in FIG. 8.

FIG. 9 shows in a fragmentary drawing the location of the terminal 136 and the bridge element 135 with respect to radiator element 133. The dimension C is 0.4 cm and the dimension D is 0.5 cm. The bridge elements 134 and 135 join the radiator elements 131 and 132 in similar fashion. The three element array 125 in FIG. 8 has a maximum gain at approximately 6770 MHz with unmatched terminal 136 connected to a 50-ohm transmission line. The efficiency of this array approaches 100% based on ground element area and has an unmatched VSWR of less than 1.4 into a 50-ohm input at 6774 MHz.

Referring again to FIG. 7, eight arrays 125, essentially identical to the array in FIG. 8, are shown interconnected by a conventional type corporate feed network 126. The dielectric sheet 140 is 9.2 cm by 15.0 cm by 0.76 mm and the arrays 125 are spaced on 2.30 cm centers in the H coordinate direction as shown by dimension F. The arrays 125 are spaced apart 2.92 cm in the E coordinate with such spacing being center to center between adjacent radiator elements in different arrays as shown by dimension G. A terminal 136 on each array is connected to a 100-ohm one-eighth wavelength section of line 141 which impedance matches and converts the complex impedance at terminal 136 to approximately 85 ohms pure resistive at the other end of the line 141. Two of the lines 141 are combined to produce 42.5 ohms at reference character 142 with this line being tapered and combined again by corporate feed network techniques well known in the art. To protect the antenna pattern in FIG. 7 from the environment, it was covered with a 0.38 mm thick sheet of similar dielectric material. This additional sheet was heat bonded to the etched surface of the antenna using a 0.038 mm layer of polymonochlorotrichloroethylene film fused in place under 50 psi at 400°F (204°C).

Figure 10:
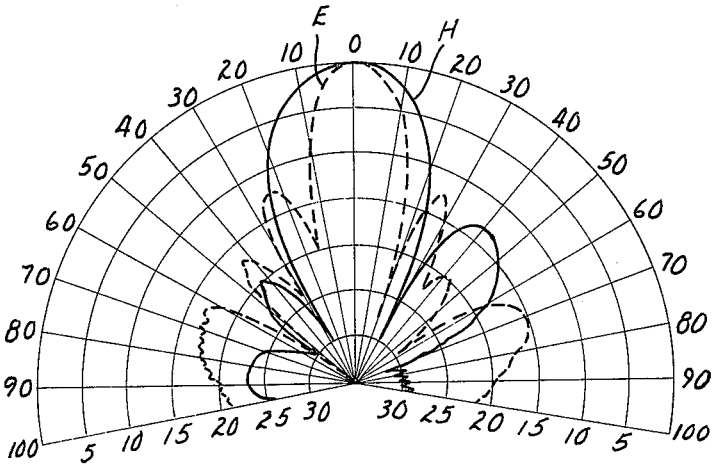
FIG. 10 is a plot of the E and H plane radiation patterns of the antenna in FIG. 7.

FIG. 10 is a plot of the E and H field patterns of the antenna in FIG. 7 referenced to 0 db. The observed gain exceeds 90% of the theoretical gain based on ground element area at 6650 MHz with the first side lobes in the E plane being down 12 db and 12.5 db from maximum gain. The bandwidth over which the input VSWR is less than 2.0 is 285 MHz or 4.3%.

What is claimed is:

1. A microstrip antenna for radiating or detecting electromagnetic signals having a wavelength $\lambda o$ comprising:

a dielectric sheet of relative dielectric constant $\epsilon_r$, relative permeability $\mu_r$ and uniform thickness $t$ having a. on a first broad surface 1. at least three thin conductive resonant dipole radiator elements, each radiator element having two orthogonal coordinates that respectively define E and H planes of electromagnetic radiation for said radiator element, with the E plane coordinate dimension of each radiator element being approximately one-half the dielectric wavelength $\lambda o/\sqrt{\epsilon_r \mu_r}$;
2. said radiator elements conductively joined by thin conductive strips into an array or arrays of at least two radiator elements; and
3. a terminal for connecting each array to a transmission line, b. on the other broad surface an essentially continuous thin conductive ground element more than coextensive with the radiator elements which defines a radiation aperture;

wherein the improvement comprises:

a. said conductive strips comprise one or more bridge elements, each bridge element having a length providing approximately a phase reversal from end to end at the operating wavelength $\lambda o$, each bridge element conductively joining two adjacent radiator elements in the same array at edges of approximately opposite phase, the width of each bridge element being less than the H coordinate dimension of one of the radiator elements it joins and less than one-half the H coordinate dimension of the other radiator element it joins, and in each array a bridge element is conductively joined to the periphery of a radiator element at a location that is opposite in phase to a location on said radiator element where said terminal or another bridge element is connected; and b. said terminal for connecting each array to a transmission line is located on a radiator element off the element's H coordinate.

2. A microstrip antenna recited in claim 1 wherein there are at least two arrays each consisting of two radiator elements, one bridge element and one terminal.

3. A microstrip antenna recited in claim 1 wherein at least one array comprises three radiator elements, two bridge elements, and one terminal.

4. A microstrip antenna recited in claim 3 wherein the width of each bridge element is less than one-half the H coordinate dimension of each radiator element it joins.

5. A microstrip antenna recited in claim 4 wherein the radiator elements of said array of at least three radiator elements are linearly arranged.

6. A microstrip antenna recited in claim 5 wherein the terminal of said linear array is connected to a central radiator element.

7. A microstrip antenna recited in claim 5 wherein the radiator elements of the linear array are in a straight line to produce a fan type beam.

8. A microstrip antenna recited in claim 7 wherein the length of each bridge element of the linear array is such that all the radiator elements radiate substantially in phase with respect to each other.

9. A microstrip antenna recited in claim 7 wherein the line defined by the points on each radiator element of the linear array at which two bridge elements are connected is parallel to the E coordinate of said radiator element.

10. A microstrip antenna recited in claim 7 wherein each bridge element of the linear array is attached to radiator elements on opposite sides of their respective E coordinates.

11. A microstrip antenna recited in claim 7 wherein all the radiator elements of the linear array are the same size and shape.

12. A microstrip antenna recited in claim 7 wherein the size and shape of the individual radiator elements are selected to reduce the size of the radiation pattern side lobes.

13. A microstrip antenna recited in claim 3 wherein the width of each bridge element is less than one-quarter the H coordinate dimension of each radiator element it joins.

14. A microstrip antenna recited in claim 1 further including at least one capacitative tab extending from the periphery of a radiator element having a terminal to impedance match said terminal for connection to a transmission line.

15. A microstrip antenna recited in claim 1 wherein the radiator elements are arranged in at least two side-by-side linear arrays.

16. A microstrip antenna recited in claim 15 further including a thin conductive strip corporate feed network located on said first broad surface and connected to said terminal on each linear array to provide a common point for connection to said transmission line.

17. A microstrip antenna recited in claim 16 wherein each of said linear arrays comprises three radiator elements, two bridge elements and one terminal.

18. A microstrip antenna recited in claim 17 wherein the corporate feed network is so connected that each linear array of radiator elements radiates substantially in phase with respect to at least one adjacent array.

19. A microstrip antenna recited in claim 18 wherein the length of each bridge element is such that each radiator element radiates substantially in phase with respect to the other radiator elements within its array.

20. A microstrip antenna recited in claim 17 wherein the length of each bridge element is such that each radiator element radiates substantially in phase with respect to the other radiator elements within its array.

21. A microstrip antenna recited in claim 17 wherein the line defined by the points on each radiator element of said linear arrays at which two bridge elements are connected is parallel to the E coordinate of said radiator element.

22. A microstrip antenna recited in claim 17 wherein a bridge element between two adjacent radiator elements is attached to the radiator elements on opposite sides of their respective E coordinates.

23. A microstrip antenna recited in claim 17 wherein all the radiator elements are the same size and shape.

24. A microstrip antenna recited in claim 17 wherein each radiator element radiates substantially in phase with all other radiator elements.

25. A microstrip antenna recited in claim 1 wherein the dielectric sheet is planar.

26. The method of radiating or detecting electromagnetic signals having the wavelength $\lambda o$ using an antenna as defined in claim 4 involving applying or receiving signals of wavelength $o$ to at least one terminal, which signals are distributed to or from radiator elements that are electrically farther from said terminal through at least one intermediate radiator element by utilizing the phase reversal property that exists across said intermediate radiator element in the E coordinate direction to conductively distribute energy via at least one bridge element to said other radiator elements in the array.

27. The method of radiating or detecting electromagnetic signals having the wavelength $\lambda o$ using an antenna as defined in claim 13 involving applying or receiving signals of wavelength $\lambda o$ to at least one terminal, which signals are distributed to or from radiator elements that are electrically farther from said terminal through at least one intermediate radiator element by utilizing the phase reversal property that exists across said intermediate radiator element in the E coordinate direction to conductively distribute energy via at least one bridge element to said other radiator elements in the array.

28. The method of radiating or detecting electromagnetic signals having the wavelength $\lambda o$ using an antenna as defined in claim 17 involving applying or receiving signals of wavelength $\lambda o$ at the terminal of each linear array, which signals are distributed to or from radiator elements that are electrically farther from said terminal through any intermediate radiator element by utilizing the phase reversal property that exists across each intermediate radiator element in the E coordinate direction to conductively distribute energy via the bridge elements to other radiator elements in each linear array.

* * * * *

UNITED STATES PATENT AND TRADEMARK OFFICE

CERTIFICATE OF CORRECTION

PATENT NO. : 3,987,455

DATED : October 19, 1976

INVENTOR(S) : Murray Olyphant, Jr.

It is certified that error appears in the above-identified patent and that said Letters Patent are hereby corrected as shown below:

Column 3, line 17, after "210°" add -- ) --.

Column 12, line 26, after "wavelength" add -- λ --.

Signed and Sealed this

Fifteenth Day of March 1977

[SEAL]

*Attest:*

RUTH C. MASON
*Attesting Officer*

C. MARSHALL DANN
*Commissioner of Patents and Trademarks*